US008262350B2

(12) United States Patent
Yoshinaga et al.

(10) Patent No.: US 8,262,350 B2
(45) Date of Patent: Sep. 11, 2012

(54) HEAT INSULATING STRUCTURE FOR EXPANSION TURBINE, AND METHOD OF MANUFACTURING THE SAME

(75) Inventors: Seiichiro Yoshinaga, Tokyo (JP); Toshio Takahashi, Tokyo (JP); Hirohisa Wakisaka, Chigasaki (JP)

(73) Assignee: IHI Corporation (JP)

( * ) Notice: Subject to any disclaimer, the term of this patent is extended or adjusted under 35 U.S.C. 154(b) by 1081 days.

(21) Appl. No.: 12/054,916

(22) Filed: Mar. 25, 2008

(65) Prior Publication Data

US 2008/0240911 A1 Oct. 2, 2008

(30) Foreign Application Priority Data

Mar. 29, 2007 (JP) ..... P2007-089023

(51) Int. Cl.
*F01D 5/08* (2006.01)
*F04D 29/58* (2006.01)

(52) U.S. Cl. ..... 415/178

(58) Field of Classification Search ..... 415/150, 415/160, 178, 206; 62/87, 401, 402, 910
See application file for complete search history.

(56) References Cited

U.S. PATENT DOCUMENTS

| | | | | |
|---|---|---|---|---|
| 4,317,646 | A * | 3/1982 | Steel et al. | 415/116 |
| 6,382,910 | B1 * | 5/2002 | Kato et al. | 415/150 |
| 6,733,231 | B2 * | 5/2004 | Tanioka | 415/114 |
| 6,908,291 | B2 * | 6/2005 | Klein et al. | 417/420 |

FOREIGN PATENT DOCUMENTS

| | | | |
|---|---|---|---|
| JP | 47-38782 | | 9/1972 |
| JP | 54-72734 | | 6/1979 |
| JP | 59-157540 | | 10/1984 |
| JP | 60-24839 | | 2/1985 |
| JP | 63-10232 | | 1/1988 |
| JP | 6-137101 | | 5/1994 |
| JP | 07-67793 | | 3/1995 |
| JP | 2000-170915 | | 6/2000 |
| JP | 2001-132410 | | 5/2001 |
| JP | 2001152808 | A * | 6/2001 |
| JP | 2002-1424 | | 1/2002 |

OTHER PUBLICATIONS

Yoshinaga et al—JP 2001152808 Abstract Translation.*
Yoshinaga et al—JP 2001152808 Machine Translation.*
Yoshinaga et al.—JP 2001152808.*
Japanese Office Action, dated Aug. 2, 2011, issued in corresponding Japanese Patent Application No. 2007-089023. Total 6 pages, including English Translation.

* cited by examiner

*Primary Examiner* — Edward Look
*Assistant Examiner* — Su Htay
(74) *Attorney, Agent, or Firm* — Ostrolenk Faber LLP

(57) ABSTRACT

A heat insulating structure for an expansion turbine includes an adiabatic expansion device including an expander body that includes an outlet passage for refrigerant fluid at a central portion thereof and an introduction chamber for refrigerant fluid communicating with an inlet of the outlet passage on an outer peripheral portion thereof, and a turbine impeller that is rotatably provided at the inlet and braked by a braking device. The adiabatic expansion device adiabatically expands refrigerant fluid by rotating the turbine impeller with refrigerant fluid that flows from the introduction chamber to the outlet passage side. A heat-insulating layer, which surrounds the entire periphery of the outlet passage over the entire length of the introduction chamber, is formed between the introduction chamber and the outlet passage. Accordingly, it is possible to improve turbine efficiency by reducing transfer of heat of refrigerant fluid from the introduction chamber to the outlet passage.

4 Claims, 5 Drawing Sheets

HEAT INSULATING STRUCTURE FOR EXPANSION TURBINE, AND METHOD OF MANUFACTURING THE SAME

BACKGROUND OF THE INVENTION

1. Field of the Invention

The present invention relates to a heat insulating structure for an expansion turbine that is provided in a helium refrigerator or the like, and a method of manufacturing the heat insulating structure.

Priority is claimed on Japanese Patent Application No. 2007-089023, filed on Mar. 29, 2007, the content of which is incorporated herein by reference.

2. Description of Related Art

The following adiabatic expansion device is known as one kind of expansion turbine (for example, see Japanese Patent Application, First Publication No. 6-137101 and Japanese Patent Application, First Publication No. 2001-132410). The adiabatic expansion device includes an expander body that includes an outlet passage for a refrigerant fluid at a central portion thereof and an introduction chamber for the refrigerant fluid communicating with an inlet of the outlet passage on an outer peripheral portion thereof, and a turbine impeller that is rotatably provided at the inlet of the outlet passage and braked by a braking device. The adiabatic expansion device adiabatically expands the refrigerant fluid, such as helium by rotating the turbine impeller with the refrigerant fluid that has ultra low temperature and flows from the introduction chamber toward the outlet passage. Then, the adiabatic expansion device discharges the refrigerant fluid, the temperature of which falls, through an outlet of the outlet passage.

However, in the expansion turbine in the related art, the introduction chamber and the outlet passage of the expander body are isolated from each other via a solid partition wall that surrounds the entire periphery of the outlet passage. For this reason, during the operation of the expansion turbine, the heat of the refrigerant fluid corresponding to a high temperature side, which is introduced into the introduction chamber, is transferred to the refrigerant fluid corresponding to a low temperature side, which flows in the outlet passage, through the partition wall. Therefore, there is a problem in that turbine performance deteriorates. When the difference between the inlet and outlet temperatures of the refrigerant fluid in the expansion turbine is large, this problem occurs much more significantly. However, appropriate measures against the problem have not been provided yet.

SUMMARY OF THE INVENTION

The invention has been made to solve the above-mentioned problem, and an object of the invention is to provide a heat insulating structure for an expansion turbine that can improve turbine efficiency by reducing the transfer of heat of a refrigerant fluid from an introduction chamber side to an outlet passage side in an expander body, and a method of manufacturing the heat insulating structure.

According to an embodiment of the invention, a heat insulating structure for an expansion turbine includes an adiabatic expansion device that includes an expander body and a turbine impeller. The expander body includes an outlet passage for a refrigerant fluid at a central portion thereof and an introduction chamber for the refrigerant fluid communicating with an inlet of the outlet passage on an outer peripheral portion thereof. The turbine impeller is rotatably provided at the inlet of the outlet passage and braked by a braking device. The adiabatic expansion device adiabatically expands the refrigerant fluid by rotating the turbine impeller with the refrigerant fluid that flows from the introduction chamber to the outlet passage side. A heat-insulating layer, which surrounds the entire periphery of the outlet passage over the entire length of the introduction chamber, is formed in the expander body between the introduction chamber and the outlet passage.

In the above-mentioned heat insulating structure for an expansion turbine, the refrigerant fluid having ultra low temperature, which is introduced into the introduction chamber of the expander body, flows to the inlet of the outlet passage, and rotates the turbine impeller. Accordingly, the refrigerant fluid is adiabatically expanded, so that the temperature of the refrigerant fluid falls. Then, the refrigerant fluid is supplied to a device which does need to generate cold from the outlet of the outlet passage. In this case, the transfer of the heat of the refrigerant fluid corresponding to a high temperature side, which is introduced into the introduction chamber, to the refrigerant fluid corresponding to a low temperature side, which flows into the outlet passage in the expander body, is effectively suppressed by the heat-insulating layer that is formed on the entire periphery of the outlet passage of the expander body.

In the heat insulating structure for an expansion turbine according to the embodiment of the invention, the heat-insulating layer may be a vacuum heat-insulating layer that is formed of an annular vacuum space formed between the introduction chamber and the outlet passage. In the heat insulating structure of the embodiment of the invention, the transfer of the heat of the refrigerant fluid corresponding to a high temperature side, which is joined into the introduction chamber, to the refrigerant fluid corresponding to a low temperature side, which flows into the outlet passage in the expander body, can be more effectively suppressed by the vacuum heat-insulating layer.

In the heat insulating structure for an expansion turbine according to the embodiment of the invention, the expander body may include a cylindrical outer case, and a cylindrical fluid guide member that is inserted into the outer case so as to form the introduction chamber between an outer peripheral portion of the fluid guide member and an inner peripheral portion of the outer case and has the outlet passage at a central portion thereof. The fluid guide member may include a cylindrical outer fluid guide member that forms the introduction chamber between the outer case and the outer fluid guide member, and a cylindrical inner fluid guide member that has the outlet passage. The annular vacuum space may be formed by inserting the inner fluid guide member into an inner hole of the outer fluid guide member in order to fit the inner fluid guide member to both ends of the inner hole in an axial direction of the inner hole, and hermetically sealing fitting portions between the inner and outer fluid guide members. In the heat insulating structure according to the embodiment of the invention, it is possible to easily assemble the expander body including the vacuum heat-insulating layer, and to easily form the vacuum heat-insulating layer in the guide member.

A method of manufacturing a heat insulating structure for an expansion turbine according to another embodiment includes hermetically sealing the fitting portions between the inner and outer fluid guide members of the fluid guide member under vacuum by electron beam welding. In the heat insulating structure according to the embodiment of the invention, it is possible to reliably form the vacuum heat-insulating layer in the fluid guide member.

According to the heat insulating structure for an expansion turbine according to the embodiment of the invention, it is possible to effectively suppress the transfer of the heat of the refrigerant fluid from the introduction chamber side to the outlet passage side in the expander body, by the vacuum heat-insulating layer that is formed in the expander body over the entire length of the outlet passage. As a result, it is possible to improve the turbine efficiency of the expansion turbine.

DETAILED DESCRIPTION OF THE INVENTION

A heat insulating structure for an expansion turbine according to an embodiment of the invention will be described below with reference to the accompanying drawings.

Figure 1:
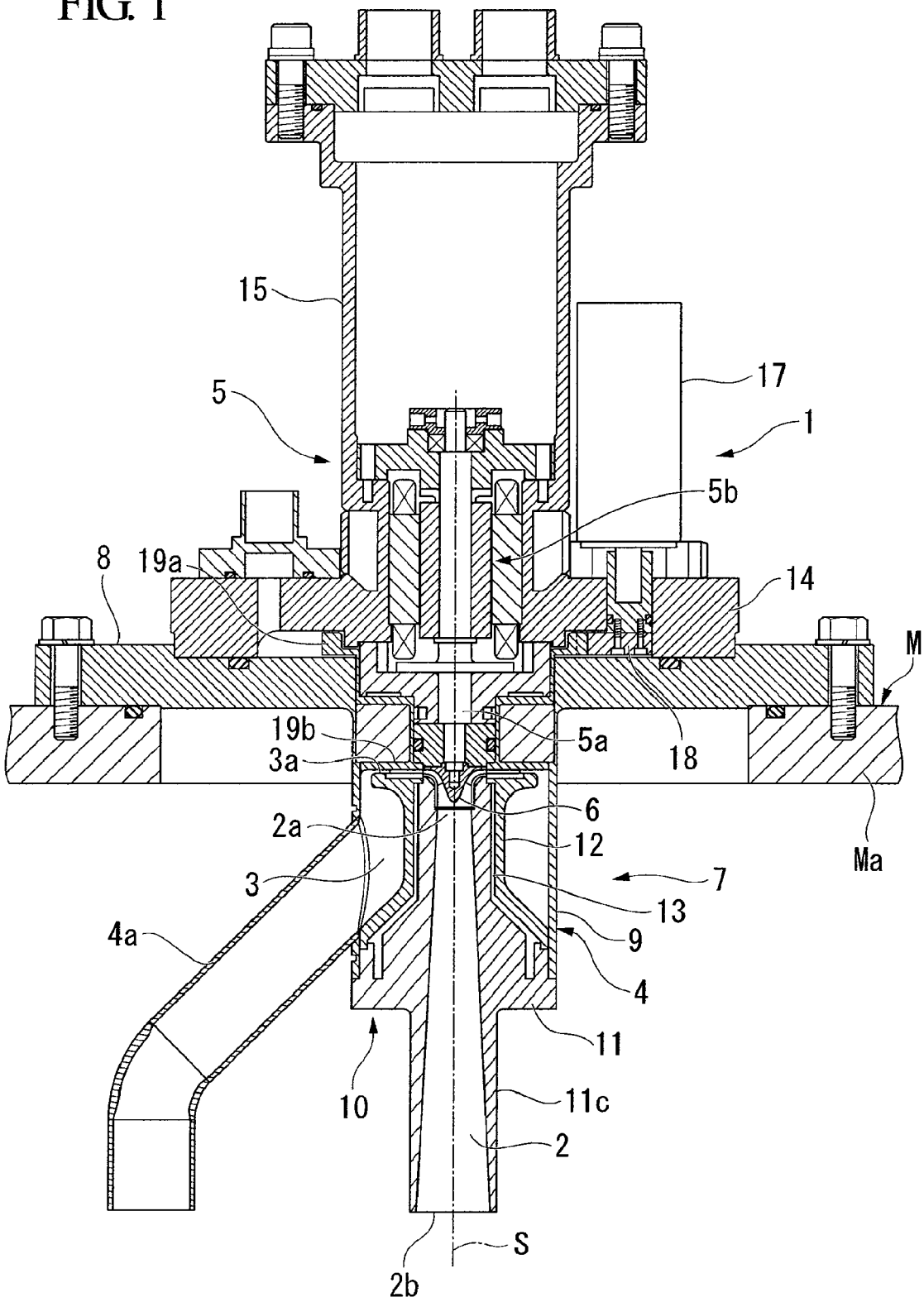
FIG. 1 is a longitudinal cross-sectional view of an expansion turbine that has a heat insulating structure according to an embodiment of the invention.

In FIG. 1, reference numeral 1 indicates an expansion turbine to which a heat insulating structure according to an embodiment of the invention is applied. The expansion turbine 1 includes an adiabatic expansion device 7 that is provided with an expander body 4 and a turbine impeller 6. An outlet passage 2 for a refrigerant fluid is formed at a central portion of the expander body 4. An introduction chamber 3 for the refrigerant fluid, which communicates with an inlet 2*a* of the outlet passage 2 through a communication passage 3*a*, is provided on the entire outer periphery of an upper half portion of the expander body. The turbine impeller 6 is rotatably provided at the inlet 2*a* of the outlet passage 2, and is braked by a braking device 5. The adiabatic expansion device 7 adiabatically expands the refrigerant fluid by rotating the turbine impeller 6 with the refrigerant fluid that has high pressure and ultra low temperature and flows from the introduction chamber 3 toward the outlet passage 2 through the communication passage 3*a*.

Figure 2:
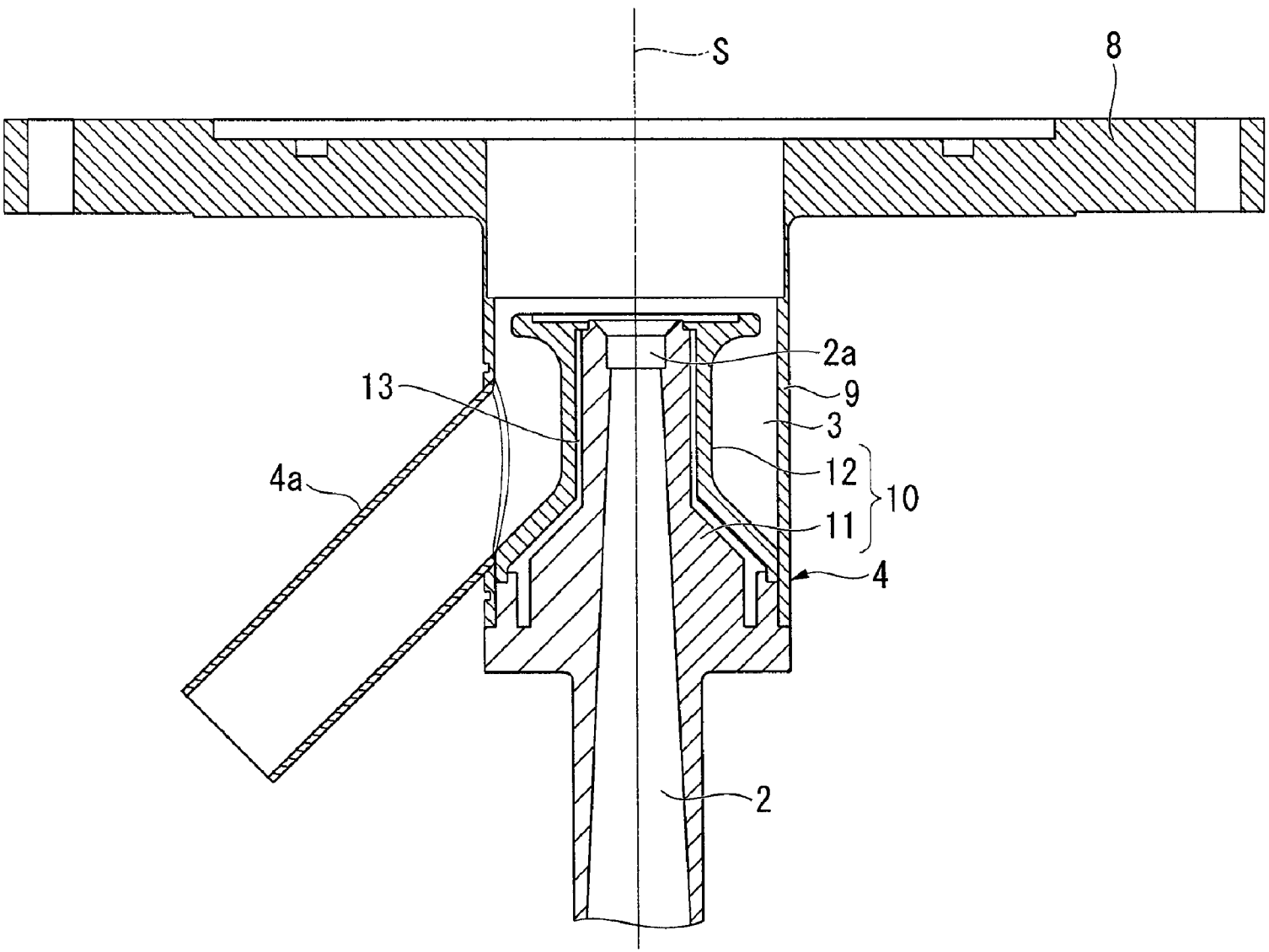
FIG. 2 is a longitudinal cross-sectional view of an expander body of an adiabatic expansion device of the expansion turbine.

As shown in FIG. 2, the expander body 4 includes a flange 8, a cylindrical outer case 9, and a cylindrical fluid guide member 10 through which the refrigerant fluid flows. An upper end (one end) of the outer case 9 is integrally fixed to the flange 8 so that an axis S of the outer case is oriented in a vertical direction. The fluid guide member 10 is inserted into the outer case 9 from below so that an axis of the fluid guide member corresponds to the axis S. The outer peripheral portion of the fluid guide member 10, which corresponds to a middle portion in the axial direction of the fluid guide member, is fitted and fixed to a lower end (the other end) of the outer case 9. The introduction chamber 3, which is formed around the axis S in an annular shape, is formed between the upper outer peripheral portion of the fluid guide member 10 in the axial direction of the fluid guide member, and the inner peripheral portion of the outer case 9. The outer case 9 and the fluid guide member 10 are inserted into a vacuum container M of a refrigerator or the like, and the flange 8 is fixed to a fitting portion Ma of the vacuum container M by bolts, so that the outer case and the fluid guide member are supported. An introduction pipe 4*a*, which introduces the refrigerant fluid into the introduction chamber 3 from a refrigerant fluid supply source, is fixed to the outer case 9 of the expander body 4.

Figure 3:
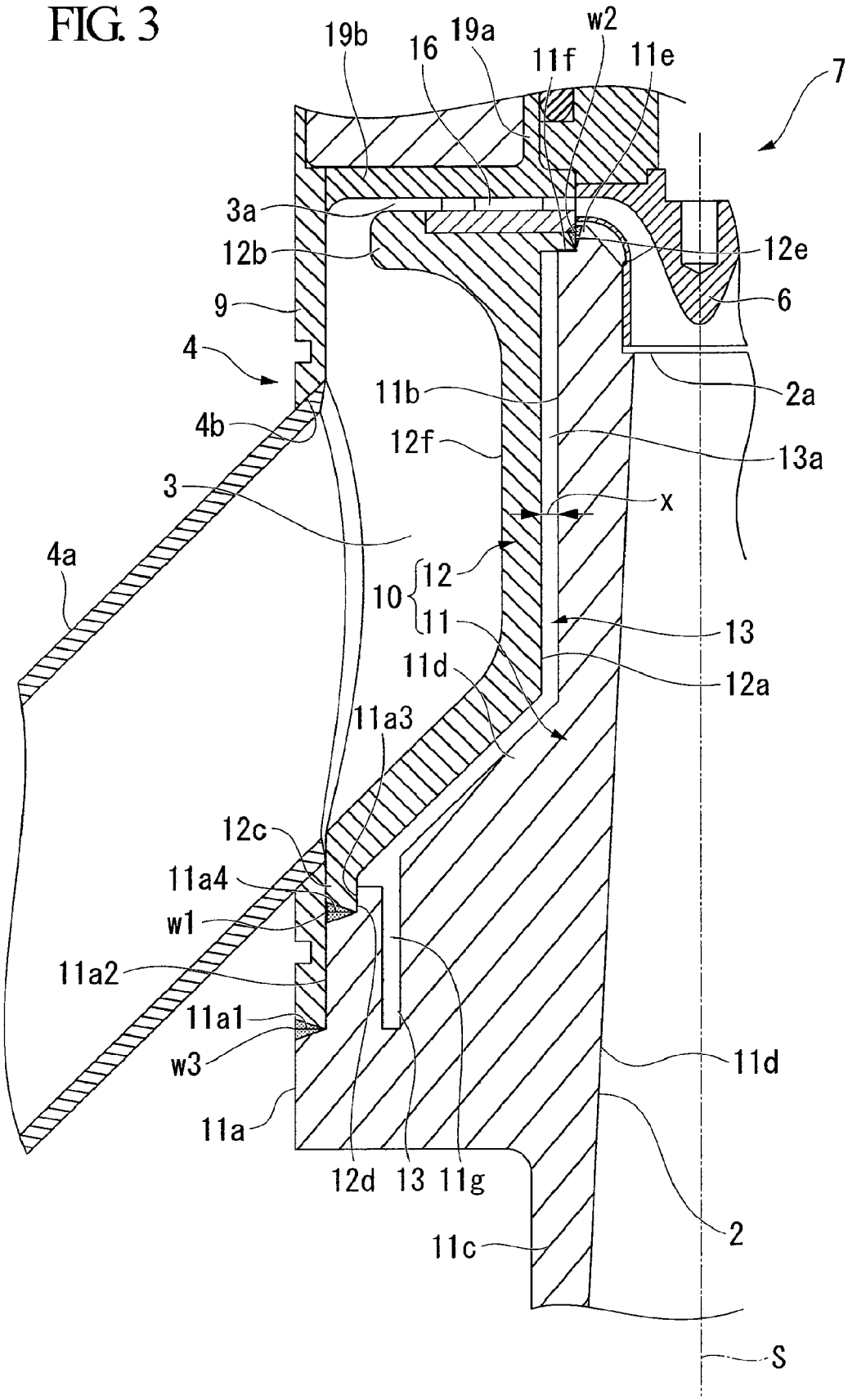
FIG. 3 is a longitudinal cross-sectional view of a main part of the heat insulating structure for the expansion turbine.

As shown in FIG. 3 (the longitudinal cross-section of only a left half of the fluid guide member 10 is shown in FIG. 3), the fluid guide member 10 includes a cylindrical inner fluid guide member 11, and a cylindrical outer fluid guide member 12 that covers the outer periphery of an upper half portion in the axial direction of the inner fluid guide member 11. The outlet passage 2, which is formed of a tapered hole a diameter of which is increased toward an outlet 2*b*, is formed at the center of the inner fluid guide member 11. An annular vacuum space (vacuum heat-insulating layer) 13, as a heat-insulating layer that is formed around the axis S, is formed between the outer peripheral portion of the inner fluid guide member 11 and the inner peripheral portion of the outer fluid guide member 12 at least over the entire length of the introduction chamber 3 in the axial direction of the introduction chamber. The annular vacuum space 13 is formed by sealing both upper and lower fitting portions of the inner and outer fluid guide members.

A large diameter portion 11*a* is formed on the outer periphery at a middle portion of the inner fluid guide member 11 in the axial direction of the inner fluid guide member. Small diameter portions 11*b* and 11*c*, each of which has a diameter smaller than the diameter of the large diameter portion 11*a*, are formed at upper and lower portions of the inner fluid guide member. First and second fitting portions 11*a*2 and 11*a*3 are formed on the large diameter portion 11*a* above a stepped portion 11*a*1 in this order from below so that the diameter of the first fitting portion is larger than that of the second fitting portion. The small diameter portions 11*b* and 11*c* are formed parallel to the axis S, and a portion between the upper small diameter portion 11*b* and the large diameter portion 11*a* forms a tapered portion 11*d* a diameter of which is increased toward the lower side of the inner fluid guide member. Further, an annular groove 11*g* is formed inside the second fitting portion 11*a*3 around the axis S. The annular groove has a depth so that the bottom thereof is positioned at substantially the same position as the lower end of the outer case 9, and is parallel to the axis S.

Furthermore, an inner hole 12*a* is formed in the outer fluid guide member 12. An inner diameter of the inner hole 12*a* is slightly larger than the diameters of the upper small diameter portion 11*b* and the middle tapered portion 11*d* of the inner fluid guide member 11 so as to form a parallel gap X therebetween. The gap X forms an annular space 13*a*. An outer peripheral portion 12*f* of the outer fluid guide member 12 is formed substantially parallel to the inner hole 12*a* (the small diameter portion 11*b* and the middle tapered portion 11*d*). A flange 12*b* protrudes outwardly from the outer periphery of the upper end of the outer fluid guide member 12. An outer periphery of a lower end portion 12*c* of the outer fluid guide member 12 has the same diameter as the first fitting portion 11*a*2 of the inner fluid guide member 11. The lower end of the inner hole 12*a* of the outer fluid guide member 12 forms a fitting hole 12*d* that is fitted to the second fitting portion 11*a*3 of the inner fluid guide member 11. In addition, an inner flange 12*e*, which is fitted to a fitting portion 11*e* formed on the outer periphery of the upper end of the inner fluid guide member 11, is formed at the upper end portion of the inner hole 12*a* of the outer fluid guide member 12. A small gap is formed between the lower surface of the inner flange 12*e* and a stepped portion 11*f* of the fitting portion 11*e*.

Further, the small diameter portion 11*b* of the inner fluid guide member 11 is inserted into the inner hole 12*a* of the outer fluid guide member 12 from below so that the fitting hole 12*d* of the outer fluid guide member 12 is fitted to the second fitting portion 11*a*3. A stepped portion 11*a*4 between the second fitting portion 11*a*3 and the first fitting portion 11*a*2 comes in contact with the lower end portion of the outer fluid guide member 12, and the fitting portion 11*e* formed at the upper end of the inner fluid guide member is fitted to the inner flange 12*e* formed at the upper end portion of the outer fluid guide member 12. Accordingly, the outer fluid guide member 12 is assembled with the inner fluid guide member 11.

After that, the inner and outer fluid guide members 11 and 12, which are assembled with each other, are provided on an appropriate working table in the vacuum container. While the working table is rotated, electron beam welding is performed at a contact portion between the stepped portion 11*a*4 of the inner fluid guide member 11 and the lower end portion 12*c* of the outer fluid guide member 12 from the outer periphery side, under vacuum by using an electron beam welding machine such as a laser welding machine. A fitting portion at the lower ends (the other ends) of the inner and outer fluid guide members 11 and 12, where the second fitting portion 11*a*3 and the fitting hole 12*d* are fitted to each other, is sealed in vacuum state by a welded portion w1. Then, a position where an electron beam is radiated is changed. That is, electron beam welding is performed at the fitting portion where the fitting portion 11*e* of the inner fluid guide member 11 and the inner flange 12*e* of the outer fluid guide member 12 are fitted to each other, under vacuum as described above. Accordingly, a fitting portion at the upper ends (one ends) of the inner and outer fluid guide members 11 and 12 is sealed in vacuum state by a welded portion w2.

Therefore, the annular space 13 a between the outer peripheral portion (small diameter portion 11*b* and the tapered portion 11*d*) of the inner fluid guide member 11 and the inner hole 12*a* of the outer fluid guide member 12 is formed as the annular vacuum space (vacuum heat-insulating layer) 13.

The upper half portion of the fluid guide member 10, which is formed as described above, is inserted into the outer case 9 from below. The first fitting portion 11*a*2 of the inner fluid guide member 11 and the lower end portion 12*c* of the outer fluid guide member 12 are fitted into the inside of the lower end of the outer case 9 so that the stepped portion 11*a*1 of the inner fluid guide member 11 comes in contact with the lower surface of the outer case 9. Then, TIG welding is performed at the contact portion from the outer periphery side in order to hermetically join the contact portion by a welded portion w3. After the welding, an inner end portion of the introduction pipe 4*a* is inserted into a hole 4*b* formed at the outer case 9, and welding is performed as described above so that the introduction pipe 4*a* is hermetically joined to the outer case 9.

Meanwhile, the annular vacuum space (vacuum heat-insulating layer) 13, which is formed between the outer peripheral portion of the inner fluid guide member 11 and the inner peripheral portion of the outer fluid guide member 12, is formed of a gap having a constant width. The longitudinal cross-section of the gap is bent in the shape of a crank so as to correspond to the shapes of the outer peripheries of the inner and outer fluid guide members 11 and the 12. However, the shape of the vacuum heat-insulating layer 13 is not limited thereto as long as the vacuum heat-insulating layer 13 is formed over the entire length of the introduction chamber 3 in the axial direction of the introduction chamber. That is, the vacuum heat-insulating layer may have a linear shape in a vertical direction, a shape where the small diameter portion 11*b* of the inner fluid guide member 11 extends downward and the tapered portion 11*d* is omitted so that the vacuum heat-insulating layer 13 has a large space at the lower portion thereof, or other shapes.

The braking device 5 is formed such that an electric generator 5*b*, which includes a rotor shaft 5*a* on the axis S, is received in a receiving case 15 that is fixed to the upper surface of the flange 8 via a flange 14. The turbine impeller 6 is fixed to the lower end of the rotor shaft 5*a*.

A variable nozzle 16, which adjusts the flow passage area of the refrigerant flowing from the introduction chamber 3 to the turbine impeller 6, is disposed on the communication passage 3*a* of the expander body 4. The variable nozzle 16 is operated by a fan-shaped gear 18 that is rotated by a pulse motor 17, a ring 19*a* that is engaged with the fan-shaped gear and rotated about the axis S, and an operation ring 19*b* that is connected to the lower end of the ring and rotated together with the ring. The operation ring 19*b* faces the upper surface of the flange 12*b* that is formed at the upper end of the outer fluid guide member 12, and the communication passage 3*a* is formed between the operation ring and the flange.

As described above, the adiabatic expansion device 7 of the expansion turbine 1 has a heat insulating structure, where the annular vacuum space (vacuum heat-insulating layer) 13 is formed between the outer peripheral portion of the inner fluid guide member 11 and the inner hole 12*a* of the outer fluid guide member 12 in the fluid guide member 10 for the refrigerant fluid over the entire length of the introduction chamber 3 in the axial direction of the introduction chamber. The refrigerant fluid having ultra low temperature, such as neon, helium, or hydrogen, which is introduced to the introduction chamber 3 of the expander body 4 through the introduction pipe 4*a*, is guided to the upper outer portion of the outer fluid guide member by the outer peripheral portion 12*f* and the flange 12*b* of the outer fluid guide member 12. Then, the refrigerant fluid is introduced into the communication passage 3*a*, and flows toward the inlet 2*a* of the outlet passage 2 through the variable nozzle 16, thereby rotating the turbine impeller 6. Accordingly, the refrigerant fluid is adiabatically expanded, so that temperature of the refrigerant fluid falls. Then, the refrigerant fluid is supplied to a refrigerator or the like, which does need to generate cold, from the outlet 2*b* of the outlet passage 2. In this case, the transfer of the heat of the refrigerant fluid corresponding to a high temperature side, which is introduced into the introduction chamber 3, to the refrigerant fluid corresponding to a low temperature side, which flows to the outlet passage 2 side from the outer fluid guide member 12 through the inner fluid guide member 11 in the expander body 4, is effectively suppressed by the vacuum heat-insulating layer 13 that is formed in the expander body 4 so as to surround the entire periphery of the outlet passage 2. As a result, the turbine efficiency of the expansion turbine 1 is improved.

Figure 4:
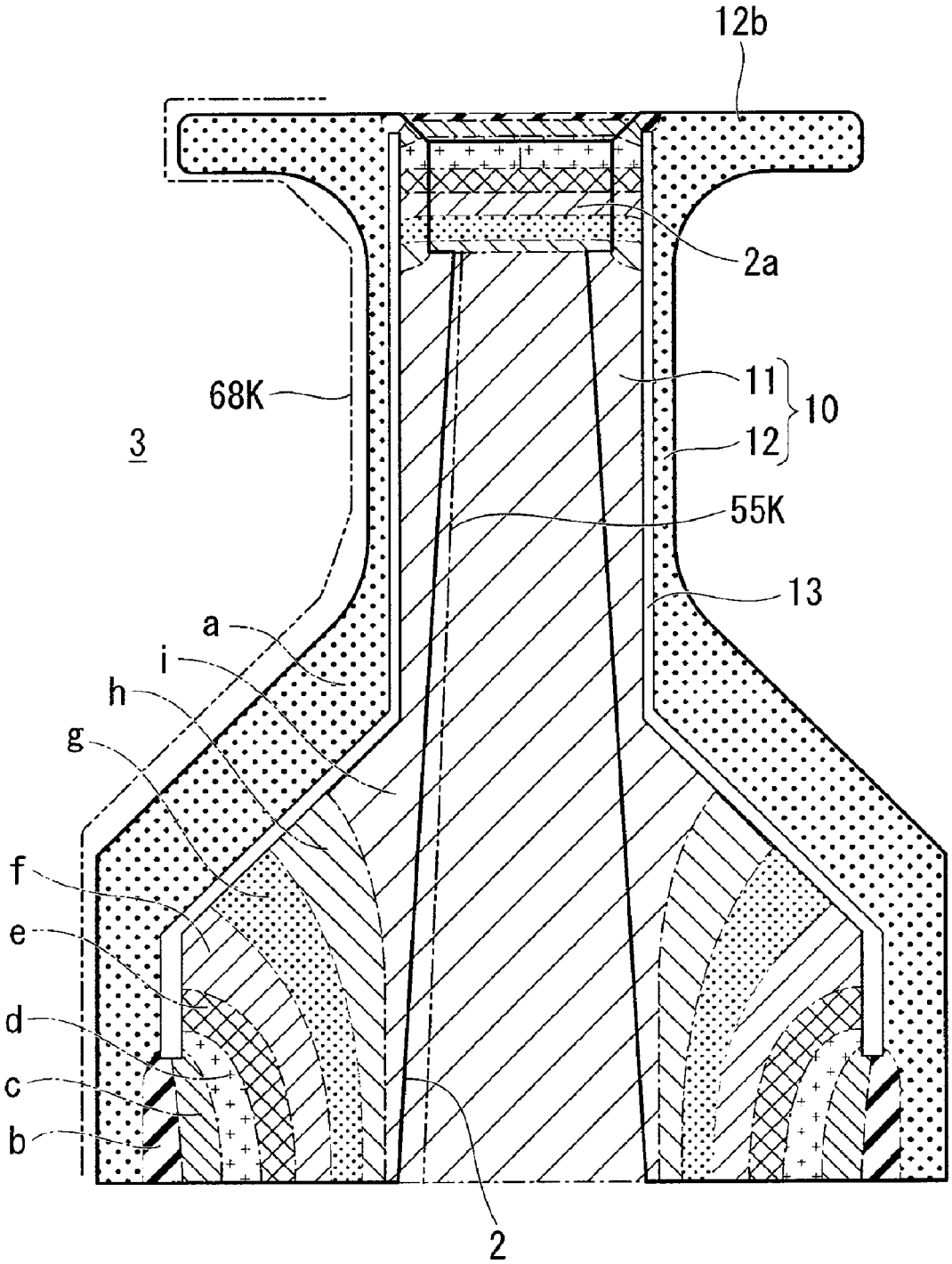
FIG. 4 is a temperature distribution diagram of a fluid guide member of an adiabatic expansion device in a performance test of the expansion turbine that has the heat insulating structure according to the embodiment of the invention.
Figure 5:
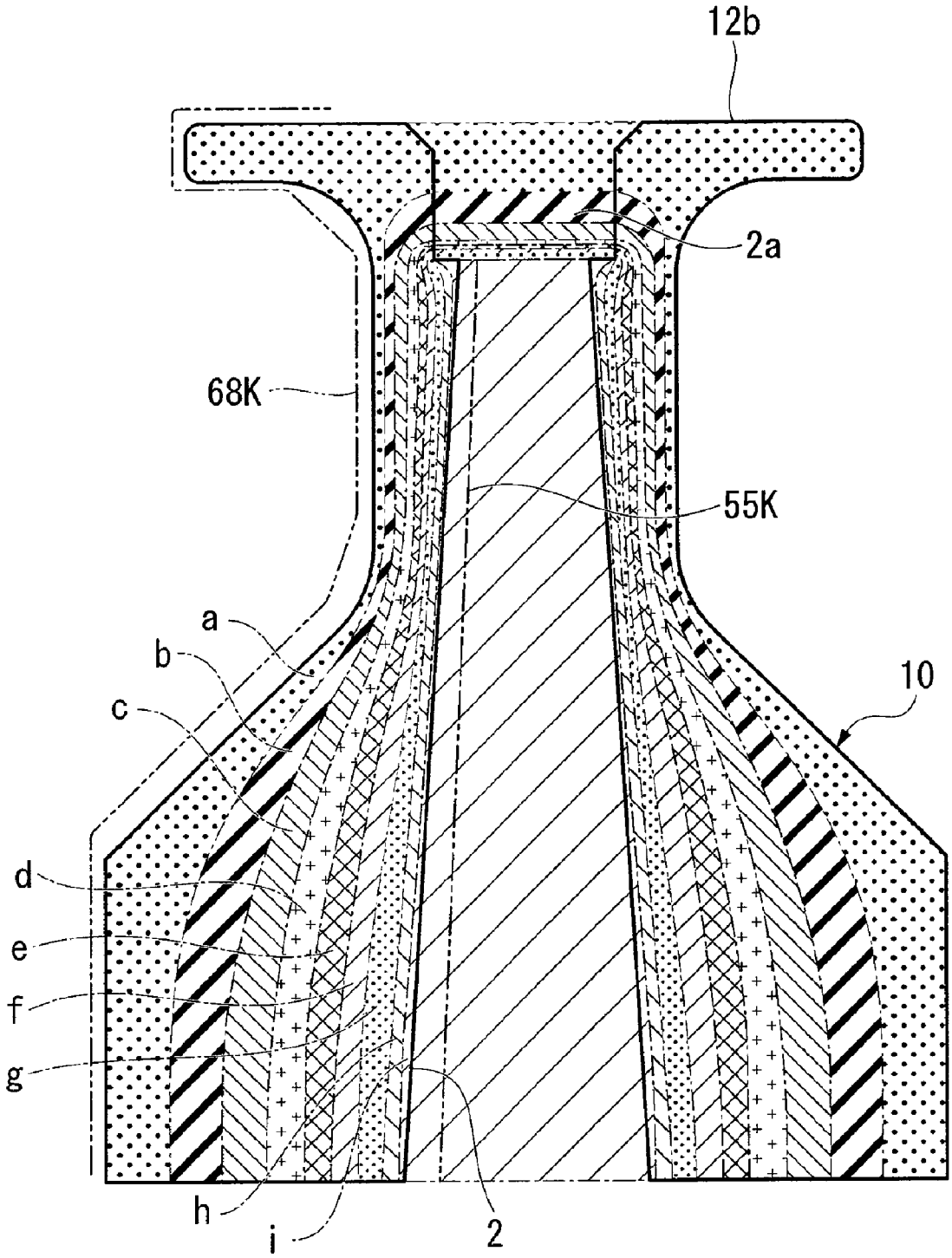
FIG. 5 is a temperature distribution diagram of a fluid guide member of an adiabatic expansion device in a performance test of an expansion turbine in the related art.

In addition, FIGS. 4 and 5 are isothermal diagrams showing the heat distribution of the fluid guide member 10, which is obtained by FEM analysis of the expansion turbine 1 where the vacuum heat-insulating layer 13 according to the invention is provided in the fluid guide member 10 of the expander body 4 and an expansion turbine without the vacuum heat-insulating layer.

FIG. 4 shows the heat distribution of the fluid guide member 10 when the temperature of neon falls to an absolute temperature of 55K and is discharged through the outlet passage 2 after neon corresponding to a high temperature side having an absolute temperature of 68K is introduced into the introduction chamber 3 and rotates the turbine impeller 6 in the expansion turbine 1 including the vacuum heat-insulating layer 13 according to the invention. The temperature of the outer portion of the vacuum heat-insulating layer 13 of the outer fluid guide member 12 is an absolute temperature of 68K. In contrast, as for the temperature of the inner fluid guide member 11, it is recognized that heat is slightly transferred from the outer fluid guide member 12 to the lower portion of the inner fluid guide member 11 positioned at a lower position than the tapered portion 11*d*. However, the heat transferred from the high temperature side is suppressed to be small as a whole by the vacuum heat-insulating layer 13. For this reason, the temperature of the periphery of the outlet passage 2 becomes the absolute temperature 55K, which corresponds to a low temperature side through the outlet passage 2, over the entire length. In this case, it could be seen that the heat transferred from the high temperature side to the low temperature side is about 9 W.

In contrast, FIG. 5 shows the heat distribution of the fluid guide member 10 when the temperature of neon falls to an absolute temperature of 55K and is discharged through the outlet passage 2 after neon corresponding to a high temperature side having an absolute temperature of 68K is introduced into the introduction chamber 3 and rotates the turbine impeller 6 in the expansion turbine without the vacuum heat-insulating layer 13. The temperature of the fluid guide member 10 in the vicinity of the inner peripheral surface of the outlet passage 2 is slightly higher than an absolute temperature of 55K through a temperature fall represented by an isothermal line that substantially corresponds to the shape of the outer periphery of the fluid guide member 10 from the absolute temperature 68K of the outer surface of the fluid guide member 10 toward the outlet passage 2. Accordingly, it could be seen that heat is significantly transferred from the high temperature side to the low temperature side through the fluid guide member 10. In this case, it could be seen that the heat transferred from the high temperature side to the low temperature side is about 56 W.

Meanwhile, in FIGS. 4 and 5, reference character "a" indicates a region corresponding to the temperature range of −206.4 to −205.0° C., reference character "b" indicates a region corresponding to the temperature range of −207.9 to −206.4° C., reference character "c" indicates a region corresponding to the temperature range of −209.3 to −207.9° C., reference character "d" indicates a region corresponding to the temperature range of −210.8 to −209.3° C., reference character "e" indicates a region corresponding to the temperature range of −212.2 to −210.8° C., reference character "f" indicates a region corresponding to the temperature range of −213.7 to −212.2° C., reference character "g" indicates a region corresponding to the temperature range of −215.1 to −213.7° C., reference character "h" indicates a region corresponding to the temperature range of −216.6 to −215.1° C., and reference character "i" indicates a region corresponding to the temperature range of −218.0 to −216.6° C.

The following is proved from the above-mentioned results. That is, when the vacuum heat-insulating layer 13 is formed in the fluid guide member 10 over the entire length of the introduction chamber 3 in the axial direction of the introduction chamber, the heat transferred from the high temperature side to the low temperature side is decreased to about ⅙ as compared to when the vacuum heat-insulating layer is not formed in the fluid guide member. Accordingly, the turbine efficiency is improved by about 10%.

As described above, the expander body 4 of the adiabatic expansion device 7, which adiabatically expands the refrigerant fluid, of the expansion turbine 1 according to the embodiment, includes the cylindrical outer case 9 and the cylindrical fluid guide member 10. The cylindrical fluid guide member 10 is inserted into the outer case 9 so as to form the introduction chamber 3 between the outer peripheral portion 12*f* and the inner peripheral portion of the outer case 9, and has the outlet passage 2 at the central portion thereof. The fluid guide member 10 includes the cylindrical outer fluid guide member 12 that forms the introduction chamber 3 between the outer case 9 and the outer fluid guide member, and the cylindrical inner fluid guide member 11 that has the outlet passage 2. In the heat insulating structure for the expansion turbine 1 according to the embodiment, the inner fluid guide member 11 is inserted into the inner hole 12*a* of the outer fluid guide member 12, and is fitted to both ends in the axial direction of the inner hole 12*a*. Accordingly, the annular vacuum space (vacuum heat-insulating layer) 13, which is formed by hermetically sealing the fitting portions, is formed between the inner and outer fluid guide members 11 and 12 over the entire length of the introduction chamber 3 so as to surround the entire periphery of the outlet passage 2.

Therefore, according to the heat insulating structure for the expansion turbine 1 of the embodiment, it is possible to easily form the vacuum heat-insulating layer 13, which is formed to surround the entire periphery of the outlet passage 2, by assembling the inner and outer fluid guide members 11 and 12 in the fluid guide member 1 0 of the expander body 4. In addition, it is possible to effectively suppress the transfer of the heat of the refrigerant fluid from the introduction chamber 3 side to the outlet passage 2 side through the fluid guide member 10 in the expander body 4, by the vacuum heat-insulating layer 13. As a result, it is possible to improve the turbine efficiency of the expansion turbine 1.

Further, according to the method of manufacturing the heat insulating structure for the expansion turbine 1 of the embodiment, fitting portions between both ends of the inner hole 12*a* of the outer fluid guide member 12 and the inner fluid guide member 11 in the fluid guide member 10 are hermetically sealed under vacuum by electron beam welding. Therefore, it is possible to reliably form the vacuum heat-insulating layer 13 in the fluid guide member 10.

Meanwhile, in the heat insulating structure for the expansion turbine 1 according to the embodiment, a heat-insulating layer composed of the vacuum heat-insulating layer 13 has been formed in the annular space 13*a* that is formed between the inner and outer fluid guide members by fitting the outer fluid guide member 12 to the inner fluid guide member 11. However, the invention is not limited thereto, and a heat-insulating layer may be formed by filling or attaching an appropriate heat-insulating material to the annular space 13*a*.

Further, the heat insulating structure for the expansion turbine 1 according to the embodiment has been applied to the expansion turbine where a rotating shaft of the turbine impeller 6 is disposed parallel to a vertical direction. However, the invention is not limited thereto, and the heat insulating structure for the expansion turbine according to the embodiment may be applied to an expansion turbine where a rotating shaft of the turbine impeller 6 is disposed parallel to a horizontal direction.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A heat insulating structure for an expansion turbine comprising:

an adiabatic expansion device including an expander body that includes an outlet passage for a refrigerant fluid at a central portion thereof, an introduction chamber for the refrigerant fluid communicating with an inlet of the outlet passage on an outer peripheral portion thereof, and a turbine impeller that is rotatably provided at the inlet of the outlet passage and braked by a braking device, the adiabatic expansion device adiabatically expanding the refrigerant fluid by rotating the turbine impeller with the refrigerant fluid that flows from the introduction chamber to the outlet passage side, wherein a heat-insulating layer, which is a vacuum space, and which surrounds the entire periphery of the outlet passage over the entire length of the introduction chamber, is formed between the introduction chamber and the outlet passage.

2. The heat insulating structure according to claim 1, wherein the vacuum space of the heat-insulating layer is an annular vacuum space formed between the introduction chamber and the outlet passage.

3. The heat insulating structure according to claim 2, wherein the expander body includes a cylindrical outer case, and a cylindrical fluid guide member that is joined into the outer case so as to form the introduction chamber between an outer peripheral portion of the fluid guide member and an inner peripheral portion of the outer case and has the outlet passage at a central portion thereof, the cylindrical fluid guide member includes a cylindrical outer fluid guide member that forms the introduction chamber between the outer case and the cylindrical outer fluid guide member, and a cylindrical inner fluid guide member that has the outlet passage, and the annular vacuum space is formed by inserting the cylindrical inner fluid guide member into an inner hole of the cylindrical outer fluid guide member in order to fit the inner fluid guide member to both ends of the inner hole in an axial direction of the inner hole, and hermetically sealing fitting portions between the cylindrical inner and outer fluid guide members.

4. A method of manufacturing the heat insulating structure for the expansion turbine according to claim 3, the method comprising:

hermetically sealing the fitting portions between the cylindrical inner fluid guide member and the cylindrical outer fluid guide member of the cylindrical fluid guide member under vacuum by electron beam welding.

* * * * *